United States Patent [19]

Grushkin et al.

[11] Patent Number: 4,877,707

[45] Date of Patent: Oct. 31, 1989

[54] IMAGING PROCESSES WITH COLD PRESSURE FIXABLE TONER COMPOSITIONS

[75] Inventors: Bernard Grushkin; Hui Chang, both of Pittsford; John G. Ruhland, Rochester, all of N.Y.

[73] Assignee: Xerox Corporation, Stamford, Conn.

[21] Appl. No.: 198,964

[22] Filed: May 26, 1988

[51] Int. Cl.[4] ..... G03G 9/08

[52] U.S. Cl. ..... 430/106.6; 430/110; 430/903

[58] Field of Search ..... 430/106.6, 110, 903

[56] References Cited

U.S. PATENT DOCUMENTS

| | | | |
|---|---|---|---|
| 4,262,077 | 4/1981 | Ito | 430/106.6 |
| 4,288,519 | 9/1981 | Diamond et al. | 430/110 X |
| 4,397,941 | 8/1983 | Fickes | 430/110 X |
| 4,430,408 | 2/1984 | Sitaramiah | 430/106.6 |
| 4,514,485 | 4/1985 | Ushiyama et al. | 430/106.6 |
| 4,517,272 | 5/1985 | Jadwin et al. | 430/110 |
| 4,568,625 | 2/1986 | Uchiyama et al. | 430/110 |
| 4,585,723 | 4/1986 | Kishi et al. | 430/106 |
| 4,618,556 | 10/1986 | Takenouchi | 430/110 |
| 4,640,881 | 2/1987 | Dennis | 430/106.6 |
| 4,810,610 | 3/1989 | Gruskin et al. | 430/110 X |

FOREIGN PATENT DOCUMENTS

| | | | |
|---|---|---|---|
| 58-38958 | 3/1983 | Japan | 430/106.6 |

*Primary Examiner*—Paul R. Michl
*Assistant Examiner*—Jeffrey A. Lindeman
*Attorney, Agent, or Firm*—E. O. Palazzo

[57] ABSTRACT

A single component pressure fixable toner composition comprised of resin particles selected from the group consisting of ethylene/propylene copolymers, ethylene-co-vinyl acetate polymers, polyamides, and mixtures thereof, magnetite, and a release fluid therein, which toner contains conductive particles on the surface thereof, and wherein the magnetite is present in an amount of from about 50 to about 80 percent by weight, and the toner has a resistivity of about $10^4$ to about $10^7$ ohm-cm.

16 Claims, No Drawings

IMAGING PROCESSES WITH COLD PRESSURE FIXABLE TONER COMPOSITIONS

BACKGROUND OF THE INVENTION

The present invention is generally directed to imaging processes with cold pressure fixable toner compositions, and more specifically the present invention is directed to electrophotographic and ionographic imaging processes with single component cold pressure fixable toner compositions possessing a resistivity of from about $10^4$ to about $10^7$ ohmcm. Accordingly, in an embodiment of the present invention there are provided the aforesaid imaging processes with cold pressure fixable toner compositions comprised of resin particles, a wax component, magnetite, release fluids such as silicone fuser oils, and conductive particles, such as carbon black, on the surface thereof, which toners are fixable at from about 200 to about 400 pounds per linear inch. Also, the toners of the present invention are useful for permitting the development of images in electrophotographic and ionographic imaging systems, inclusive of electrostatic imaging processes wherein pessure fixing, especially pressure fixing in the absence of heat, is selected.

Cold pressure fixing processes are known. These processes have a number of advantages in comparison to heat fixing, primarily relating to the requirements for less energy since the toner compositions used can be fused at room temperature. In some of the prior art processes substantial image smearing can result from the high pressures required. Additionally, the cold pressure fixing toner compositions of the prior art have other disadvantages in that, for example, these compositions when used for development cause in some instances images with high gloss that are of low crease resistance.

Representative prior art includes U.S. Pat. Nos. 4,430,408, which illustrates cold pressure fixable toner compositions with fluorine-modified alkyl siloxane dispersed therein; 4,514,485 wherein there is disclosed magnetic toner particles coated with a low surface energy resin, reference column 2, lines 22 to 34; 4,568,625, which discloses a developer which contains a silicone oil which has an amine on the side chain thereof, reference column 7, lines 41, to column 2, line 62; 4,517,272; 4,585,723; 4,618,556; and 4,640,881.

Of particular interest is U.S. Pat. No. 4,517,272, which discloses the reduction of hollow character defects and electrostatically transferred dry toner images by the selection of an electrostatic dry toner composition comprising a binder powder, a low surface energy liquid such as a silicone oil, and a carrier, reference column 1, beginning at line 61. Examples of silicone oils include those as illustrated in column 3, line 6. Also, apparently other liquids can be selected, see column 3, beginning at line 20. In contrast, the present invention is directed to cold pressure fixable toners that fix at pressures of, for example, 200 to 400 pounds per inch.

With further reference to the prior art, there is disclosed in U.S. Pat. No. 4,307,169 microcapsular electrostatic marking particles containing a pressure fixable core, and an encapsulating substance comprised of a pressure rupturable shell, which shell is formed by an interfacial polymerization. One shell prepared in accordance with the teachings of this patent is a polyamide obtained by interfacial polymerization. In the 169 patent, it is indicated that when magnetite or carbon black is selected they must be treated in a separate process to prevent migration thereof to the oil phase.

Moreover, there is disclosed in U.S. Pat. No. 4,407,922 interfacial polymerization processes for pressure sensitive toner compositions comprised of a blend of two immiscible polymers selected from the group consisting of certain polymers as a hard component, and polyoctadecylvinylether-co-maleic anhydride as a soft component.

Additionally, illustrated in a copending application U.S. Ser. No. 621,307, entitled Single Component Cold Pressure Fixable Encapsulated Toner Compositions, are single component cold pressure fixable toner compositions, wherein the shell selected can be prepared by an interfacial polymerization process. A similar teaching is present in copending application U.S. Ser. No. 718,676, the disclosure of which is totally incorporated herein by reference, direced to single component magnetic cold pressure fixable toner compositions. In the aforementioned application, the core can be comprised of magnetite and a polyisobutylene of a specific molecular weight encapsulated in a polymeric shell material generated by an interfacial polymerization process. More specifically, there is illustrated in the aforementioned copending application cold pressure fixable magnetic single component developers with small amounts of carbon black and large amounts of magnetite.

Accordingly, there is a need forimproved imaging processes with contamination free cold pressure fixable toner compositions useful in electrophotographic, and ionographic imaging processes. Also, there is a need for imaging processes with single component cold pressure fixable toner compositions of a conductivity of from about $10^4$ to about $10^7$ ohm-cm. There is also a need for contamination free ionographic processes with cold pressure fixable toner compositions containing release fluids such as silicone oils and certain resin particles. Moreover, there is a need for ionographic imaging and printing processes, such as those encompassed by the commercially available Delphax 4060 TM printer, which compositions contain therein silicone oils, and thereon conductive particles such as carbon black. There is also a need for single component toner compositions that are pressure fixable at from about 200 to about 400 pounds per linear inch. Additionally, there is a need for imaging processes wherein images of excellent quality with substantially no background deposits are consistently obtained. Another need of the present invention resides in obtaining pressure fixable toners with an average particle diameter of from about 10 to about 30 microns, which toners can be obtained in high yield by the utilization of known micronization apparatuses; and pressure fixable toners, which do not agglomerate at temperatures of up to 150° F., that is a pressure fixable toner that exhibits excellent blocking properties.

Furthermore, there is a need for pressure fixable toners, and imaging and printing methods utilizing such toners wherein the toners exhibit excellent flow properties, particularly in developer housings such as those as illustrated in U.S. Pat. No. 4,692,017, the disclosure of which is totally incorporated herein by reference.

SUMMARY OF THE INVENTION

It is an object of the present invention to provide imaging processes with cold pressure fixable toner compositions with the advantages indicated herein.

In another object of the present invention there are provided electrophotographic, and ionographic imaging and printing processes with cold pressure fixable toner compositions of a resistivity of from about $10^4$ to about $10^7$ ohm-cm, and which compositions contain therein release fluids such as silicone oils.

Also, in a further object of the present invention there are provided electrophotographic, and ionographic imaging and printing processes with toner compositions that are pressure fixable at from about 200 to about 400 pounds per linear inch.

An additional object of the present invention resides in the provision of a cold pressure fixable toner with optimized smear and fix properties.

Additionally, in another object of the present invention there are provided certain cold pressure fixable toner compositions with magnetitite and silicone oils incorporated therein.

In another object of the present invention there are provided imaging and printing processes with cold pressure fixable toners, and wherein there results image of excellent quality for extended time periods, and wherein the images are permanently fixed.

Furthermore, in another object of the present invention there are provided single component cold pressure fixable toner compositions with a resistivity of from about $10^4$ to about $10^7$ ohm-cm, which compositions contain therein an optional waxy component, a release fluid, and conductive particles on the surface thereof; and wherein these toners can be pressure fixed at from about 200 to about 400 pounds per linear inch.

These and other objects of the present invention are accomplished by the provision of electrophotographic, and ionographic imaging and printing processes with single cold pressure fixable toner compositions containing release fluids therein. More specifically, there are provided in accordance with the present invention ionographic printing processes with cold pressure fixable toner compositions comprised of resin particles, magnetite particles, release fluids, and conductive particles on the surface thereof, which compositions are of a resistivity of from about $10^4$ to about $10^7$ ohm-cm, and will fix at pressure of from about 200 to about 400 pounds per linear inch.

In one embodiment of the present invention there are provided single component pressure fixable toner compositions with a resistivity of from about $10^4$ to about $10^7$ ohm-cm, which compositions are comprised of resin particles, magnetite usually present in an amount of from about 50 to about 80 percent by weight, an optional waxy component, and a release fluid contained in the toner composition; and which toner compositions contain conductive particles on the surface thereof; and wherein such toners can be pressure fixed by exerting a force of from about 200 to about 400 pounds per linear inch. Generally, a mixture of resin particles is selected as illustrated hereinafter.

Illustrative examples of resin particles or mixtures thereof present in appropriate effective amounts, such as from about 20 to about 70 weight percent, and selected for the toner compositions of the present invention include those known suitable thermoplastics such as polyolefins, polyamides, copolymers of ethylene and vinyl acetate, and mixtures thereof. Polyolefins that are preferred are low molecular weight high density polyethylene, polypropylene, or copolymers of ethylene and propylene such as Polywax 2000 or Petrolite CP-12, available from Petrolite Corporation. Examples of polyamides include those available from Henkel Corporation such as Versamid 744, Versamid 712, and the like, which have properties desirable for pressure fixing toner. Also, ethylene-co-vinyl acetate resins such as Elvax 410, 420 or 450, obtained from DuPont Company can be selected for the resin blend. Thus, a resin binder blend of Polywax 2000 (about 50 to about 70 percent), Elvax 420 (about 15 to about 25 percent), and Versamid 744 (about 15 to about 25 percent) can be admixed with magnetites by melt blending techniques, which compositions are then micronized by mechanical or air attrition to toner size particles of from about 7 to about 30 microns average diameter. In addition, mixtures of polyolefins can be selected to achieve enhanced fusing. Thus, Polywax 2000 (about 10 to about 70 percent), Polywax 500 (about 10 to about 70 percent), Elvax 420 (about 15 to about 25 percent), and Versamid 744 (about 15 to about 25 percent) blended with magnetite.

Magnetites that can be selected for incorporation into the cold pressure fixable toner compositions illustrated herein are commercially avaialbe, such as MO-7029, MO-8029, and MO-4431 from Pfizer Corporation; Mapico Black from Columbian Chemicals Inc.; Bayferrox magnetites from Mobay Chemical; and the like. These magnetites, which may be admixed with carbon black, are present in an amount of from about 40 percent by weight to about 80 percent by weight, and preferably from about 50 to 65 percent by weight.

Additionally, the toner compositions selected for the imaging and printing processes of the present invention have incorporated therein release fluids in amounts of from about 0.1 to about 3 percent, and preferably about 0.25 to 0.5 percent by weight. Examples of release fluids include silicone oils, such as polydimethylsiloxanes, polydimethyldiphenylsiloxanes, polyfluoroalkylsiloxanes, and dimethylsiloxane-alkylene oxide copolymers, and the like, available from Dow Corning or Dynamit Nobel Chemicals. Generally, the release fluids selected have a viscosity of from about 100 to about 10,000 centistokes.

Illustrative examples of conductive components that are present on the surface of the toner compositions illustrated herein include carbon blacks available from Cabot, Degussa, Capuava and Columbian carbon blacks such as Regal® 330, Vulcan XC-72R, Raven 5750, 5250, 5250B, 3500 and 3200, BP2000,BP1300, Printex type carbon blacks, and N-326 carbon black available from Capuava. The carbon black can be present in various effective amounts such as from about 0.3 percent by weight to about 5 percent by weight, and preferably from about 0.3 to about 2 weight percent.

The toner compositions of the present invention can be prepared by a number of known methods including melt mixing the components such as the resin particles, magnetites and release oils in an extruder, followed by rapidly cooling, crushing and micronizing the product obtained to toner size particles by air attrition equipment. Fines and coarse materials are then removed by classification to enable toner compositions with an average diameter of from, for example, about 15 to about 35 microns. Thereafter, conductive particles such as carbon black are affixed to the toner surface by blending the toner prepared and carbon black in a high energy mill, which blending is continued until there is obtained a suitable powder resistivity of, for example, from about $5\times10^4$ to about $1\times10^8$ ohm-cm. The resistivity was determined in a $1\times1$ centimeter cell mounted on a magnet, and filled with the carbon black treated toner. Resistivity is determined by measuring the current through the cell when 10 volts is applied to one centimeter squared electrode on opposite faces of the cell, which are aligned parallel to the poles of the magnet.

The toner compositions of the present invention, when selected for the electrophotographic and ionographic imaging systems disclosed herein, enable prints of high quality with excellent solids and line density of from about 1.4 to about 1.6, for example, reflected optical density as measured on a Macbeth densitometer, and which images are substantially permanently fixed to the paper substrate and exhibit excellent crease resistance characteristics.

The following examples are being submitted to further define various species of the present invention. These examples are intended to be illustrative only and are not intended to limit the scope of the present invention. Also, in the Examples, parts and percentages are by weight unless otherwise indicated.

EXAMPLE I

There was prepared a cold pressure fixable toner composition by melt blending 27 percent of Petrolite Polywax 2000, 6 percent Elvax 420, 6 percent Versamid 744, 60 percent Mapico Black, an 1 percent ofsilicone oil, Xerox Part No. 8R79. Thereafter, the resulting toner, subsequent to classification and micronization, and which had an average particle size diameter of 23 microns, was surface treated with 1.75 percent Regal® 330 carbon black in a Labmaster II high energy blender, enabling a toner composition with a resistivity of $10^8$ ohm-cm as determined by filling a $1\times1\times1$ centimeter cell with toner and measuring the current while 10 volts is passed through the powder while in a magnetic field.

Three hundred grams of the prepared toner was then placed into the Delphax 4060 TM printer, wherein the primary development roll to dielectric drum spacing was preset at 30 mils, and the magnet angle and bias were adjusted to produce test prints with a reflection optical density of 1.55, after which 2,000 prints of a 6 percent area coverage test document were generated. Images were transferred and fixed to paper substrate in a single step wherein the paper passes between the dielectric cylinder drum and a pressure roll set at 300 pounds per linear inch. Throughout this test there was no evidence of solid area image deletion which can result in toner remaining on the dielectric drum and printing onto subsequent pages, nor was there any evidence of image density decreasing. Crease resistance and image smear were satisfactory as determined by visual observation.

In a stress test wherein a low area coverage document (0.5 percent) was selected, there was no evidence of loss of optical density after producing 10,000 prints.

EXAMPLE II

A toner composition was prepared by repeating the procedure of Example I with the exception that 0.45 percent silicone oil was used. This toner was surface treated with 1.20 percent of BP1300 carbon black, obtained from Cabot Corporation, to produce a toner with a resistivity of $5.6\times10^4$ ohm-cm. When tested in the 4060 TM printer, results comparable to that of Example I were obtained.

EXAMPLE III

A toner composition was prepared by repeating the procedure of Example I with the exception that 0.25 percent silicone oil was used. This toner was surface treated with 0.40 percent of BP2000 carbon black in a high energy mill until a resistivity of $1\times10^5$ ohm-cm was reached. This toner, when tested in the Delphax 4060 TM printer, produced excellent prints of 1.5 to 1.6 optical density with no background deposits. There was no evidence of toner offset during a 2,000 print test. Also, there was no evidence of toner dirt accumulating in the development housing after 2,000 print cycles.

EXAMPLE IV

A toner composition was prepared by repeating the procedure of Example I with the exception that no silicone oil was used. One toner was surface treated with 1.75 percent Regal® 330 carbon black, and a second toner with 0.40 percent of BP2000 carbon black. Both toners, when tested in the Delphax 4060 TM printer, produced black solid areas wherein a substantial part of the image had remained on the dielectric receptor resulting in excessive contamination of the electroreceptor, which could not be readily cleaned with a brush.

EXAMPLE V

A toner composition was prepared by repeating the procedure of Example I with the exception that 14 percent Petrolite Polywax 2000 and 14 percent Polywax 500 were melt blended with 6 percent Elvax 420, 6 percent Versamid 744, and 60 percent Mapico Black. During the course of melt blending, silicone oil in an amount of 0.25 percent by weight of the total composition was added. To this toner composition, 0.45 percent of the carbon black BP2000 was added by the same blending method used in Example I, resulting in a toner resistivity of $1\times10^5$ ohm-cm. Print tests in the 4060 TM printer with 6 percent area coverage and 0.5 percent area coverage documents generated excellent quality images with no background deposits. Pressure fixability was satisfactory based on a finger rub test and a crease test. Prints with solid area densities of 1.5 also were generated. There was no evidence of toner offsetting onto the dielectric drum.

EXAMPLES VI

A toner composition was prepared wherein 40 percent of a crosslinked styrene-n-butylmethacrylate copolymer (58/42) was melt mixed wth 59.5 percent Mapico Black magnetite and 0.5 percent silicone oil. The toner was then classified to an average volume size of 20 microns, followed by surface treatment with 0.40 percent of BP2000 carbon black. Although prints could be made with the Delphax 4060 TM printer, they did not fix well to the paper based on a crease test, a tape peel test, and a rub test. Most of the images could be readily removed from the paper.

Other modifications of the present invention may occur to those skilled in the art based upon a reading of the present disclosure, and these modifications are intended to be included within the scope of the present invention.

What is claimed is:

1. A single component pressure fixable toner composition comprised of resin particles selected from the group consisting of ethylene/propylene copolymers, ethylene-co-vinyl acetate polymers, polyamides, and mixtures thereof, magnetite, and a release fluid therein, which toner contains conductive particles on the surface thereof, and wherein the magnetite is present in an amount of from about 50 to about 80 percent by weight, and the toner has a resistivity of about $10^4$ to about $10^7$ ohm-cm.

2. A single component toner composition in accordance with claim 1 wherein a mixture of resin particles is selected.

3. A single component toner composition in accordance with claim 2 wherein the mixture is comprised of an ethylene/propylene copolymer, an ethylene-co-vinyl acetate polymer, and a polyamide.

4. A single component toner composition in accordance with claim 1 wherein the conductive particles are comprised of carbon black.

5. A single component toner composition in accordance with claim 4 wherein the conductive particles are present in an amount of from about 0.3 percent to about 2 percent by weight.

6. A single component toner composition in accordance with claim 1 wherein the release fluid has a viscosity of from about 100 to about 10,000 centistokes.

7. A single component toner composition in accordance with claim 1 wherein the release fluid is a silicone oil.

8. A toner composition in accordance with claim 6 wherein the release fluid is a silicone oil.

9. A single component toner composition in accordance with claim 1 wherein the resin particles consist essentially of a mixture of an ethylene/propylene copolymer, an ethylene-co-vinyl acetate polymer, and a polyamide.

10. A single component toner composition in accordance with claim 1 wherein the resin particles consist essentially of a mixture of an ethylene-co-vinyl acetate polymer and a polyamide.

11. A single component toner composition in accordance with claim 1 wherein the resin particles consist essentially of an ethylene/propylene copolymer.

12. A single component toner composition in accordance with claim 1 wherein the resin particles consist essentially of a mixture of ethylene/propylene copolymers.

13. A single component toner composition in accordance with claim 9 wherein the release fluid is a silicone oil.

14. A single component toner composition in accordance with claim 9 wherein the release fluid has a viscosity of from about 100 to about 10,000 centistokes.

15. A single component toner composition in accordance with claim 1 wherein an ethylene/propylene copolymer is present in an amount of about 27 percent by weight, an ethylene-co-vinyl acetate polymer is present in an amount of about 6 percent by weight, a polyamide is present in an amount of about 6 percent by weight, magnetite is present in an amount of about 60 percent by weight, silicone oil is present in an amount of about 1 percent by weight, and the conductive particles on the surface of the toner comprise carbon black and are present in an amount of about 2 percent by weight.

16. A single component pressure fixable toner composition consisting essentially of resin particles selected from the group consisting of ethylene/propylene copolymers, ethylene-co-vinyl acetate polymers, polyamides, and mixtures thereof, magnetite, and a release fluid therein, which toner contains conductive particles on the surface thereof, and wherein the magnetite is present in an amount of from about 50 to about 80 percent by weight, and the toner has a resistivity of about $10^4$ to about $10^7$ ohm-cm.

* * * * *